US006079845A

United States Patent [19]

Kreider

[11] Patent Number: 6,079,845

[45] Date of Patent: Jun. 27, 2000

[54] LIGHT DEVICE FOR ATTACHMENT TO A KEY RING

[76] Inventor: Joyce A. Kreider, 3308 Lincoln Hwy. East, Paradise, Pa. 17562

[21] Appl. No.: 09/036,422

[22] Filed: Mar. 5, 1998

[51] Int. Cl.[7] ..... F22V 33/00

[52] U.S. Cl. ..... 362/116; 362/189; 362/200

[58] Field of Search ..... 362/116, 189, 362/200

[56] References Cited

U.S. PATENT DOCUMENTS 5,463,539 10/1995 Vandenbelt et al. ..... 362/116

FOREIGN PATENT DOCUMENTS 29867 7/1919 Germany ..... 362/200

*Primary Examiner*—Sandra O'Shea
*Assistant Examiner*—John A. Ward

[57] ABSTRACT

A new key light for attaching to a key ring. The inventive device includes a housing with opposite first and second faces, and first and second portions. The first portion is generally rectangular and is positioned towards the proximal end of the housing. The second portion of the housing is generally triangular and is positioned towards the distal end of the housing. The second portion has a distal vertex positioned adjacent the distal end of the housing. The second portion of the housing has a bore is extended therethrough. The bore is positioned adjacent the distal vertex. A light source is provided in the interior of the housing and is located in the second portion of the housing. One of the sides of the second portion of the housing has an opening therethrough for permitting passage of light emitted from the light source through it. An actuator is provided in the interior of the housing and is located in first portion of the housing. The actuator is electrically coupled to the light source. A power source is also provided in the interior of the housing and is located in the first portion of the housing and adjacent the second face of the housing. The power source is also electrically coupled to the light source.

15 Claims, 1 Drawing Sheet

LIGHT DEVICE FOR ATTACHMENT TO A KEY RING

BACKGROUND OF THE INVENTION

1. Field of the Invention

The present invention relates to light devices for attachment to key chains and more particularly pertains to a new key light for attaching to a key ring.

2. Description of the Prior Art

The use of light devices for attachment to key chains is known in the prior art. More specifically, light devices for attachment to key chains heretofore devised and utilized are known to consist basically of familiar, expected and obvious structural configurations, notwithstanding the myriad of designs encompassed by the crowded prior art which have been developed for the fulfillment of countless objectives and requirements.

Known prior art light devices for attachment to key chains include U.S. Pat. No. 4,864,474; U.S. Pat. No. 5,442,529; U.S. Pat. No. Des. 297,647; U.S. Pat. No. Des. 339,916; U.S. Pat. No. Des. 324,954; and U.S. Pat. No. Des. 307,671.

While these devices fulfill their respective, particular objectives and requirements, the aforementioned patents do not disclose a new key light. The inventive device includes a housing with opposite first and second faces, and first and second portions. The first portion is generally rectangular and is positioned towards the proximal end of the housing. The second portion of the housing is generally triangular and is positioned towards the distal end of the housing. The second portion has a distal vertex positioned adjacent the distal end of the housing. The second portion of the housing has a bore is extended therethrough. The bore is positioned adjacent the distal vertex. A light source is provided in the interior of the housing and is located in the second portion of the housing. One of the sides of the second portion of the housing has an opening therethrough for permitting passage of light emitted from the light source through it. An actuator is provided in the interior of the housing and is located in first portion of the housing. The actuator is electrically coupled to the light source. A power source is also provided in the interior of the housing and is located in the first portion of the housing and adjacent the second face of the housing. The power source is also electrically coupled to the light source.

In these respects, the key light according to the present invention substantially departs from the conventional concepts and designs of the prior art, and in so doing provides an apparatus primarily developed for the purpose of attaching to a key ring.

SUMMARY OF THE INVENTION

In view of the foregoing disadvantages inherent in the known types of light devices for attachment to key chains now present in the prior art, the present invention provides a new key light construction wherein the same can be utilized for attaching to a key ring.

The general purpose of the present invention, which will be described subsequently in greater detail, is to provide a new key light apparatus and method which has many of the advantages of the light devices for attachment to key chains mentioned heretofore and many novel features that result in a new key light which is not anticipated, rendered obvious, suggested, or even implied by any of the prior art light devices for attachment to key chains, either alone or in any combination thereof.

To attain this, the present invention generally comprises a housing with opposite first and second faces, and first and second portions. The first portion is generally rectangular and is positioned towards the proximal end of the housing. The second portion of the housing is generally triangular and is positioned towards the distal end of the housing. The second portion has a distal vertex positioned adjacent the distal end of the housing. The second portion of the housing has a bore is extended therethrough. The bore is positioned adjacent the distal vertex. A light source is provided in the interior of the housing and is located in the second portion of the housing. One of the sides of the second portion of the housing has an opening therethrough for permitting passage of light emitted from the light source through it. An actuator is provided in the interior of the housing and is located in first portion of the housing. The actuator is electrically coupled to the light source. A power source is also provided in the interior of the housing and is located in the first portion of the housing and adjacent the second face of the housing. The power source is also electrically coupled to the light source.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new key light apparatus and method which has many of the advantages of the light devices for attachment to key chains mentioned heretofore and many novel features that result in a new key light which is not anticipated, rendered obvious, suggested, or even implied by any of the prior art light devices for attachment to key chains, either alone or in any combination thereof.

It is another object of the present invention to provide a new key light which may be easily and efficiently manufactured and marketed.

It is a further object of the present invention to provide a new key light which is of a durable and reliable construction.

An even further object of the present invention is to provide a new key light which is susceptible of a low cost of manufacture with regard to both materials and labor, and which accordingly is then susceptible of low prices of sale to the consuming public, thereby making such key light economically available to the buying public.

Still yet another object of the present invention is to provide a new key light which provides in the apparatuses and methods of the prior art some of the advantages thereof, while simultaneously overcoming some of the disadvantages normally associated therewith.

Still another object of the present invention is to provide a new key light for attaching to a key ring.

Yet another object of the present invention is to provide a new key light which includes a housing with opposite first and second faces, and first and second portions. The first portion is generally rectangular and is positioned towards the proximal end of the housing. The second portion of the housing is generally triangular and is positioned towards the distal end of the housing. The second portion has a distal vertex positioned adjacent the distal end of the housing. The second portion of the housing has a bore is extended therethrough. The bore is positioned adjacent the distal vertex. A light source is provided in the interior of the housing and is located in the second portion of the housing. One of the sides of the second portion of the housing has an opening therethrough for permitting passage of light emitted from the light source through it. An actuator is provided in the interior of the housing and is located in first portion of the housing. The actuator is electrically coupled to the light source. A power source is also provided in the interior of the housing and is located in the first portion of the housing and adjacent the second face of the housing. The power source is also electrically coupled to the light source.

Still yet another object of the present invention is to provide a new key light that allows a user to shine light on the area around a lock while simultaneously inserting a key on attached key ring into the lock.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
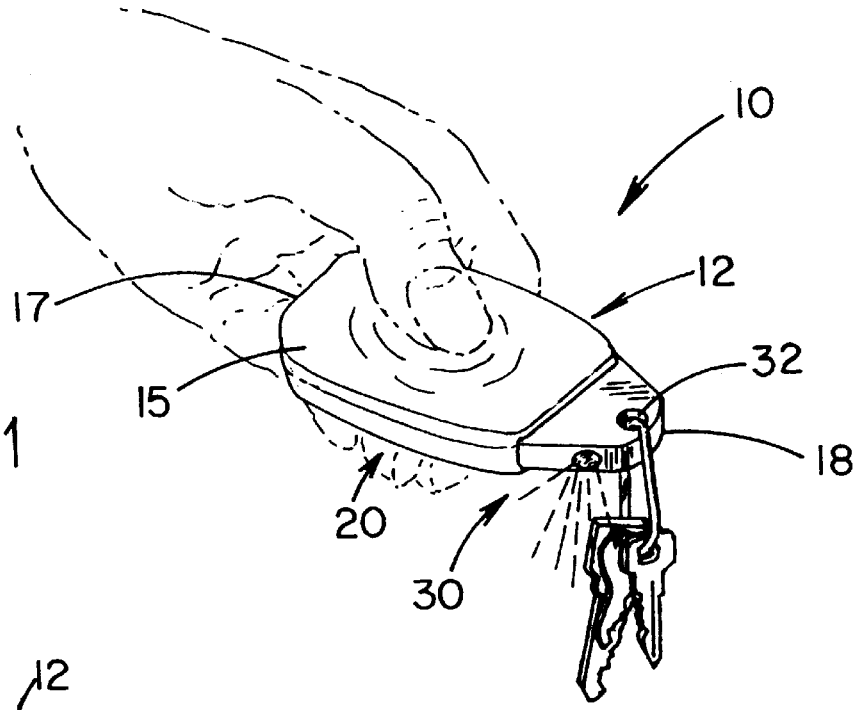
FIG. 1 is a schematic perspective view of a new key light in use according to the present invention.
Figure 2:
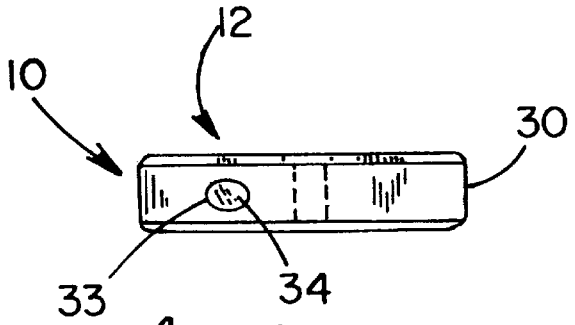
FIG. 2 is a schematic distal side view of the present invention.
Figure 3:
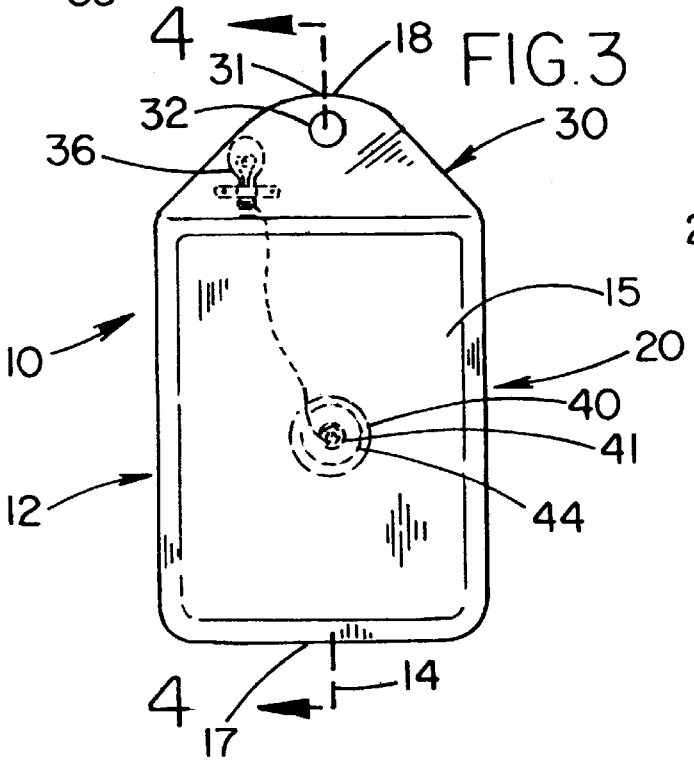
FIG. 3 is a schematic first side view of the present invention.
Figure 4:
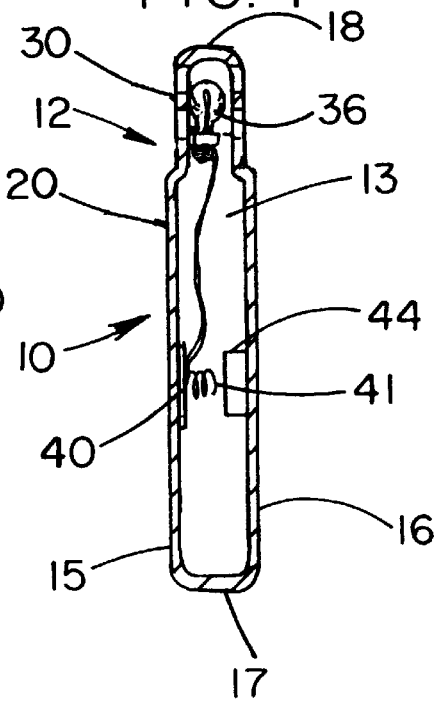
FIG. 4 is a schematic cross sectional view of the present invention taken from line 4—4 on FIG. 3.

With reference now to the drawings, and in particular to FIGS. 1 through 4 thereof, a new key light embodying the principles and concepts of the present invention and generally designated by the reference numeral 10 will be described.

The key light 10 is designed for attachment to a key ring so that a user can shine a light over the area adjacent a key ring attached to the device. As best illustrated in FIGS. 1 through 4, the key light 10 generally comprises a housing 12 with opposite first and second faces 15,16, and first and second portions 20,30. The first portion 20 is generally rectangular and is positioned towards the proximal end of the housing 12. The second portion 30 of the housing 12 is generally triangular and is positioned towards the distal end of the housing 12. The second portion 30 has a distal vertex 31 positioned adjacent the distal end of the housing 12. The second portion 30 of the housing 12 has a bore 32 is extended therethrough. The bore 32 is positioned adjacent the distal vertex 31. A light source 36 is provided in the interior 13 of the housing 12 and is located in the second portion 30 of the housing 12. One of the sides of the second portion 30 of the housing 12 has an opening 33 therethrough for permitting passage of light emitted from the light source 36 through it. An actuator 40 is provided in the interior 13 of the housing 12 and is located in first portion 20 of the housing 12. The actuator 40 is electrically coupled to the light source 36. A power source 44 is also provided in the interior 13 of the housing 12 and is located in the first portion 20 of the housing 12 and adjacent the second face 16 of the housing 12. The power source 44 is also electrically coupled to the light source 36.

In closer detail, the housing 12 has an interior 13, a longitudinal axis 14, opposite first and second faces 15,16, first and second portions 20,30, and opposite proximal and distal ends 17,18. The first portion 20 is generally rectangular and has a pair of short sides and a pair of long sides, and a plurality of corners. Preferably, the portions of the first and second faces 15,16 located on the first portion 20 are flexible to permit squeezing of the opposite first and second faces 15,16 towards one another. Also preferably, the corners of the first portion 20 are generally rounded to help prevent accidental scratching of other surfaces with the housing 12. The first portion 20 is positioned towards the proximal end 17 of the housing 12. In the preferred embodiment of the invention, the short sides of the first portion 20 are generally perpendicular to the longitudinal axis 14 of the housing 12 while the long sides of the housing 12 are generally parallel to the longitudinal axis 14. Ideally, the length of the short sides are less than about the length of the long sides and more than about half the length of the long sides so that the first portion 20 is easily held in the hand of a user.

The second portion 30 of the housing 12 is generally triangular and is positioned towards the distal end of the housing 12. The second portion 30 has a distal vertex 31 and a pair of sides which are extended from the distal vertex 31 towards the first portion 20. The distal vertex 31 is positioned adjacent the distal end of the housing 12 and is preferably located along the longitudinal axis 14 of the housing 12. In the preferred embodiment of the invention, the distal vertex 31 is generally rounded to help prevent accidental scratching of other surfaces with the housing 12. The second portion 30 of the housing 12 has a generally circular bore 32 is extended through it between the first and second faces 15,16 of the housing 12. The bore 32 is positioned adjacent the distal vertex 31 of the second portion 30 and is centrally located on the longitudinal axis 14 of the housing 12. The bore 32 is designed for extending a key ring through it to attach the key ring to the second portion 30 of the housing 12.

The portions of the first and second faces located on the first portion 20 define a first portion thickness between them while the portions of the first and second faces located on the second portion 30 define a second portion thickness between them. Ideally, the second portion 30 thickness is less than the first portion 20 thickness.

The light source 36 is provided in the interior 13 of the housing 12 and is located in the second portion 30 of the housing 12. The light source 36 is designed for providing a light when powered. One of the sides of the second portion 30 of the housing 12 has an generally circular opening 33 though it to permit passage of light emitted from the light source 36 through it. Preferably, the opening 33 is located between the longitudinal axis 14 and one of the corners of the first portion 20. Ideally, a generally transparent lens 34 covers the opening 33.

The actuator 40 is provided in the interior 13 of the housing 12 in the first portion 20 of the housing 12. Preferably, the actuator 40 is centrally positioned in the first portion 20 and along the longitudinal axis 14 of the housing 12. The actuator 40 is electrically coupled to the light source 36. In the preferred embodiment, the actuator 40 includes a spring 41 which is extended in the interior 13 of the housing 12 from the first face 15 of the housing 12 towards the second face 16 of the housing 12. The power source 44 is electrically coupled to the light source to provided in the interior 13 of the housing 12 and is designed for powering the light source 36. The power source 44 is located in the first portion 20 of the housing 12 and adjacent the second face 16 of the housing 12. Like the actuator, the power source 44 is preferably centrally positioned in the first portion 20 of the housing 12. Ideally, the power source 44 is a battery.

In use, moving or squeezing the first and second faces 15,16 of the first portion 20 towards one another permits contact of the spring 41 with the power source 44 such that a circuit is completed to power the light source 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light device for attachment to a key ring, said light device comprising:

a housing having an interior, a longitudinal axis, opposite first and second faces, first and second portions, and opposite proximal and distal ends;

said first portion being generally rectangular and having a pair of short sides and a pair of long sides, and a plurality of corners, said first portion being positioned towards said proximal end of said housing;

said second portion of said housing being generally triangular and being positioned towards said distal end of said housing, said second portion having a distal vertex and a pair of sides being extended from said distal vertex towards said first portion, said distal vertex being positioned adjacent said distal end of said housing;

said second portion of said housing having a bore being extended therethrough, said bore being positioned adjacent said distal vertex of said second portion;

a light source being provided in said interior of said housing, said light source being located in said second portion of said housing;

one of said sides of said second portion of said housing having an opening therethrough, said opening of said side of said second portion of said housing being permitting passage therethrough of light emitted from said light source;

an actuator being provided in said interior of said housing, said actuator being located in first portion of said housing, said actuator being electrically coupled to said light source;

a power source being provided in said interior of said housing, said power source being located in said first portion of said housing and adjacent said second face of said housing, said power source being electrically coupled to said light source;

wherein said distal vertex is located along said longitudinal axis of said housing.

2. The device of claim 1, wherein said corners of said first portion being generally rounded, and wherein said distal vertex is generally rounded.

3. The device of claim 1, wherein said short sides of said first portion are generally perpendicular to said longitudinal axis of said housing, and wherein said long sides of said housing are generally parallel to said longitudinal axis of said housing.

4. The device of claim 1, wherein the length of said short sides of said first portion are less than about the length of said long sides of said first portion and more than about half the length of said long sides of said first portion.

5. The device of claim 1, wherein said portions of said opposite first and second faces of said housing located on said first portion are flexible, wherein said actuator includes a spring being extended in said interior of said housing from said first face of said housing towards said second face of said housing, wherein moving said first and second faces of said first portion towards one another permits contact of said spring with said power source such that a circuit is completed to power said light source.

6. The device of claim 1, wherein said portions of said opposite first and second faces of said housing located on said first portion define a first portion thickness therebetween, wherein said portions of said opposite first and second faces of said housing located on said second portion define a second portion thickness therebetween, wherein said second portion thickness is less than said first portion thickness.

7. The device of claim 1, wherein a generally transparent lens covers said opening of said side of said second portion of said housing.

8. A light device for attachment to a key ring, said light device comprising:

a housing having an interior, a longitudinal axis, opposite first and second faces, first and second portions, and opposite proximal and distal ends;

said first portion being generally rectangular and having a pair of short sides and a pair of long sides, and a plurality of corners, said corners of said first portion being generally rounded, said first portion being positioned towards said proximal end of said housing;

said short sides of said first portion being generally perpendicular to said longitudinal axis of said housing, said long sides of said housing being generally parallel to said longitudinal axis of said housing, wherein the length of said short sides of said first portion are less than about the length of said long sides of said first portion and more than about half the length of said long sides of said first portion;

said portions of said opposite first and second faces of said housing located on said first portion being flexible;

said second portion of said housing being generally triangular and being positioned towards said distal end of said housing, said second portion having a distal vertex and a pair of sides being extended from said distal vertex towards said first portion, said distal vertex being positioned adjacent said distal end of said housing, said distal vertex being located along said longitudinal axis of said housing, wherein said distal vertex is generally rounded;

said second portion of said housing having a generally circular bore being extended therethrough between said first and second faces of said housing, said bore being positioned adjacent said distal vertex of said second portion;

wherein said portions of said opposite first and second faces of said housing located on said first portion define a first portion thickness therebetween, wherein said portions of said opposite first and second faces of said housing located on said second portion define a second portion thickness therebetween, wherein said second portion thickness is less than said first portion thickness;

a light source being provided in said interior of said housing, said light source being located in said second portion of said housing;

one of said sides of said second portion of said housing having an opening therethrough, said opening of said side of said second portion of said housing being permitting passage therethrough of light emitted from said light source, wherein a generally transparent lens covers said opening of said side of said second portion of said housing;

an actuator being provided in said interior of said housing, said actuator being located in first portion of said housing, wherein said actuator is centrally positioned in said first portion of said housing, said actuator being electrically coupled to said light source, said actuator including a spring being extended in said interior of said housing from said first face of said housing towards said second face of said housing;

a power source being provided in said interior of said housing, said power source being located in said first portion of said housing and adjacent said second face of said housing, wherein said power source is centrally positioned in said first portion of said housing, said power source being electrically coupled to said light source, wherein said power source is a battery; and wherein moving said first and second faces of said first portion towards one another permits contact of said spring with said power source such that a circuit is completed to power said light source.

9. A light device for attachment to a key ring, said light device comprising:

a housing having an interior, a longitudinal axis, opposite first and second faces, first and second portions, and opposite proximal and distal ends;

said first portion being generally rectangular and having a pair of short sides and a pair of long sides, and a plurality of corners, said first portion being positioned towards said proximal end of said housing;

said second portion of said housing being generally triangular and being positioned towards said distal end of said housing, said second portion having a distal vertex and a pair of sides being extended from said distal vertex towards said first portion, said distal vertex being positioned adjacent said distal end of said housing;

said second portion of said housing having a bore being extended therethrough, said bore being positioned adjacent said distal vertex of said second portion;

a light source being provided in said interior of said housing, said light source being located in said second portion of said housing;

one of said sides of said second portion of said housing having an opening therethrough, said opening of said side of said second portion of said housing being permitting passage therethrough of light emitted from said light source;

an actuator being provided in said interior of said housing, said actuator being located in first portion of said housing, said actuator being electrically coupled to said light source;

a power source being provided in said interior of said housing, said power source being located in said first portion of said housing and adjacent said second face of said housing, said power source being electrically coupled to said light source;

wherein said portions of said opposite first and second faces of said housing located on said first portion are flexible;

wherein said actuator includes a spring being extended in said interior of said housing from said first face of said housing towards said second face of said housing; and wherein moving said first and second faces of said first portion towards one another permits contact of said spring with said power source such that a circuit is completed to power said light source.

10. The device of claim 9, wherein said corners of said first portion being generally rounded, and wherein said distal vertex is generally rounded.

11. The device of claim 9, wherein said short sides of said first portion are generally perpendicular to said longitudinal axis of said housing, and wherein said long sides of said housing are generally parallel to said longitudinal axis of said housing.

12. The device of claim 9, wherein the length of said short sides of said first portion are less than about the length of said long sides of said first portion and more than about half the length of said long sides of said first portion.

13. The device of claim 9, twherein said distal vertex is located along said longitudinal axis of said housing.

14. The device of claim 9, wherein said portions of said opposite first and second faces of said housing located on said first portion define a first portion thickness therebetween, wherein said portions of said opposite first and second faces of said housing located on said second portion define a second portion thickness therebetween, wherein said second portion thickness is less than said first portion thickness.

15. The device of claim 9, wherein a generally transparent lens covers said opening of said side of said second portion of said housing.

* * * * *